US007975986B2

(12) United States Patent
Bhachu et al.

(10) Patent No.: US 7,975,986 B2
(45) Date of Patent: Jul. 12, 2011

(54) ALL-AIR VEHICLE LIFTING JACK

(75) Inventors: Manminder Bhachu, Mississauga (CA); Narinder Bhachu, Mississauga (CA)

(73) Assignee: 2111091 Ontario Ltd., Brampton, ON (CA)

( * ) Notice: Subject to any disclaimer, the term of this patent is extended or adjusted under 35 U.S.C. 154(b) by 485 days.

(21) Appl. No.: 12/108,560

(22) Filed: Apr. 24, 2008

(65) Prior Publication Data

US 2008/0272351 A1 Nov. 6, 2008

Related U.S. Application Data

(60) Provisional application No. 60/952,594, filed on Jul. 30, 2007, provisional application No. 60/915,716, filed on May 3, 2007.

(51) Int. Cl.
*A62B 3/00* (2006.01)
*B66F 3/24* (2006.01)
*E21D 15/44* (2006.01)

(52) U.S. Cl. ..... 254/93 R; 254/93 L; 254/93 HP

(58) Field of Classification Search ..... 254/93 R, 254/93 L, 93 HP
See application file for complete search history.

(56) References Cited

U.S. PATENT DOCUMENTS 2,804,118 A * 8/1957 Bayerkohler ..... 72/392
3,015,470 A * 1/1962 Patchen ..... 254/93 HP
4,817,412 A * 4/1989 Hinson ..... 72/305

* cited by examiner

*Primary Examiner* — Joseph J Hall, III
*Assistant Examiner* — Shantese McDonald
(74) *Attorney, Agent, or Firm* — Marks & Clerk

(57) ABSTRACT

Disclosed is an all-air jack for lifting a vehicle, comprising: a frame assembly; a first bellow at an upper portion of the frame assembly; a second bellow at a lower portion of the frame assembly; an air bellow attachment plate positioned between the first and second bellows; an air supply with a first and second air tube, the first air tube in communication with the first bellows and the second air tube in communication with the second bellows; wherein inflation of the bellows raises the jack to lift the vehicle. The first and second air tubes and air supply are connectable by a 3-way air valve. Preferably, 120 psi of air is used to inflate the bellows.

7 Claims, 6 Drawing Sheets

ALL-AIR VEHICLE LIFTING JACK

CROSS-REFERENCE TO RELATED APPLICATION

This application claims the benefit of U.S. Provisional Application No. 60/915,716 filed May 3, 2007 and U.S. Provisional Application No. 60/952,594 filed Jul. 30, 2007, both of which are incorporated by reference herein.

FIELD OF THE INVENTION

The present invention relates to vehicle lifting products. More specifically, the present invention relates to an all-air vehicle lifting jack.

BACKGROUND OF THE INVENTION

Lifting devices are commonly used to lift vehicles for servicing and maintenance. Currently hydraulic hoists can be used to produce an 18 inch lift. Hoists pick up the entire car and can lift up to 8 feet. However, hydraulic hoists are expensive and produce a higher than required lift making them inefficient. This is because hoists are meant to pick up the entire car.

Sometimes it is desirable to only lift one axle in the front or back of a vehicle. Jacks are such devices that meant to pick up only one axle of a car (front or back). A hydraulic jack currently on the market has a lifting capacity of 12,000 lbs, and can be slightly modified to lift anywhere from 6,000 lbs to 50,000 lbs. Typically these jacks are not stand-alone jacks and are used as an add-on to hoists. They are generally designed to roll along a rail.

SUMMARY OF THE INVENTION

An all-air vehicle lifting jack is disclosed. The vehicle lifting jack in accordance with the teachings of this invention provides an 18 inch stroke using an all air system (no hydraulics). The air jack operates with the use of a dual air bellow system. Current systems may use single air bellows but have never devised a method of combining bellows. This invention uses a unique method of combining more than one air bellow to produce a higher than normal stroke not currently seen in other products. Up until now this level of lift height was only possible through a hydraulic system.

Thus, according to one aspect, the invention provides an all-air jack for lifting a vehicle, comprising: a frame assembly; a first bellow at an upper portion of the frame assembly; a second bellows at a lower portion of the frame assembly; an air bellow attachment plate positioned between the first and second bellows; an air supply with a first and second air tube, the first air tube in communication with the first bellows and the second air tube in communication with the second bellows; wherein inflation of the bellows raises the jack to lift the vehicle. The first and second air tubes and air supply are connectable by a 3-way air valve.

Preferably a minimum of 120 psi of air is used to inflate the bellows. Thus, according to one aspect, the invention provides an all-air jack for lifting a vehicle, comprising: a frame assembly; a first bellows at an upper portion of the frame assembly; a second bellows at a lower portion of the frame assembly; an air bellow attachment plate positioned between the first and second bellows; an air supply with a first and second air tube, the first air tube in communication with the first bellows and the second air tube in communication with the second bellows; wherein inflation of the bellows raises the jack to lift the vehicle. The first and second air tubes and air supply are connectable by a 3-way air valve. The valve is used to pump air in. The valve acts as a block to ensure air does not flow out of the back until it is released. A minimum of 120 psi of air is used to inflate the bellows.

There are many advantages in using a jack in accordance with the teachings of this invention. The jack provides the ability to lift vehicles to a height higher than what is currently provided by existing jack beams in the North American market, while running solely operating on air. Embodiments of the jack produce an 18 inch lifting stroke. Since the jack in accordance with the teachings of this invention runs on an all-air system, no hydraulics are needed, making it environmentally friendly (a green product). Further, a jack in accordance with the teachings of this invention is also a stand-along product that does not require use of a hoist with it. Other embodiments of the jack are meant to stay stationary in one spot.

Other aspects and advantages of embodiments of the invention will be readily apparent to those ordinarily skilled in the art upon a review of the following description.

BRIEF DESCRIPTION OF THE DRAWINGS

Embodiments of the invention will now be described in conjunction with the accompanying drawings, wherein.

This invention will now be described in detail with respect to certain specific representative embodiments thereof, the materials, apparatus and process steps being understood as examples that are intended to be illustrative only. In particular, the invention is not intended to be limited to the methods, materials, conditions, process parameters, apparatus and the like specifically recited herein.

DETAILED DESCRIPTION OF THE DISCLOSED EMBODIMENTS

Figure 1:
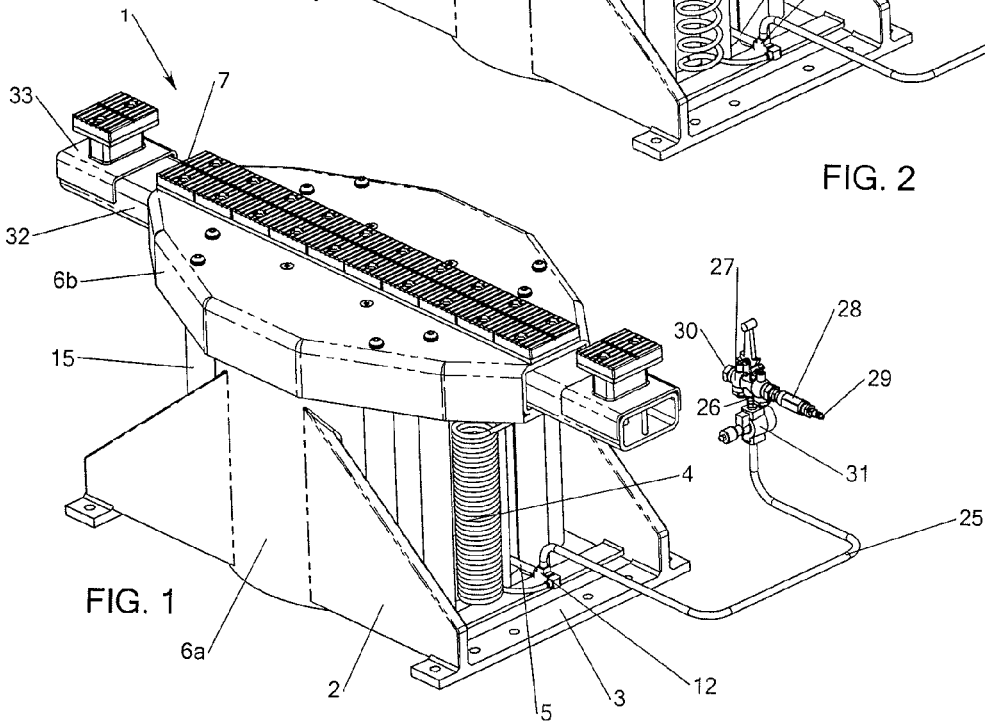
FIG. 1 is an isometric perspective of a jack in accordance with the teachings of this invention in a lowered position.

Referring to FIG. 1, there is illustrated a jack 1 in accordance with the teachings of this invention. The jack 1 is preferably made of steel. It will be understood that the grade of steel and the specifications of the steel used are based on lift capacity, long term wear and tear, safety and overall product design. The lower frame assembly of the jack 6*a* is supported by four arms 2 and anchoring brackets 3 on both sides to allow the jack 1 to be fixed to the ground securing it firmly. Jack 1 also includes upper frame assembly 6*b*.

Figure 2:
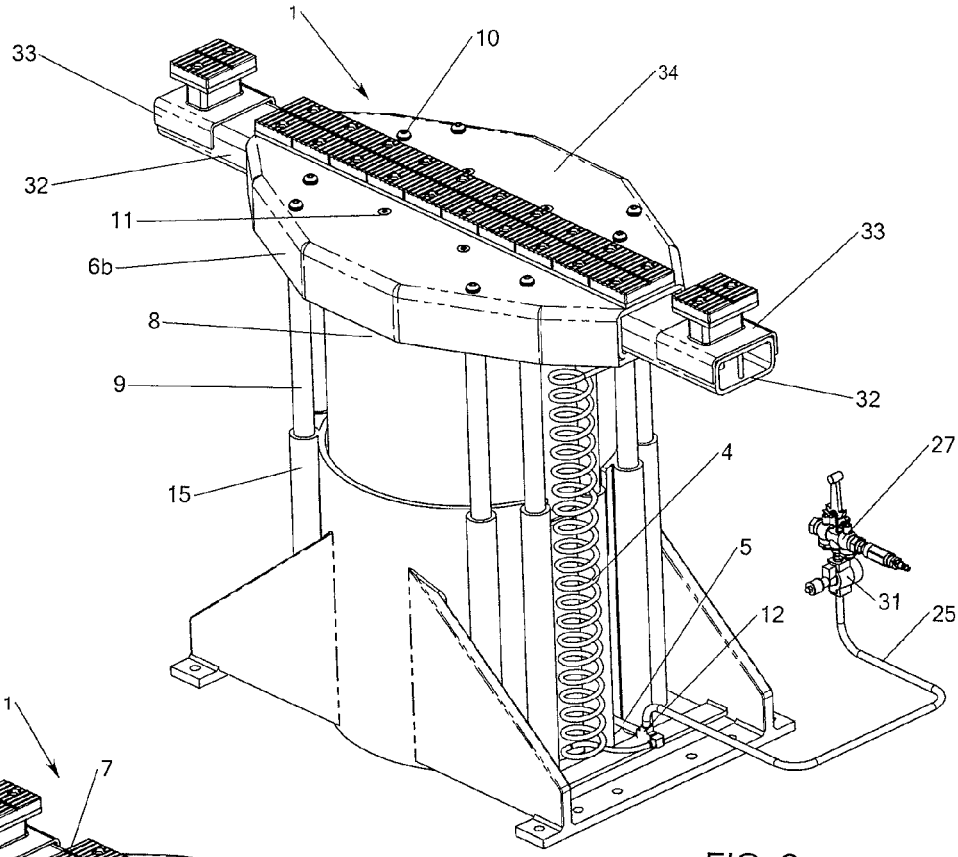
FIG. 2 is an isometric perspective of the jack of FIG. 1 in a raised position showing the full 18 inch stroke.

Referring to FIG. 2, the jack 1 includes lower frame assembly 6*a* and upper frame assembly 6*b* which is composed of two main parts: the inside steel shell 8 and the lifting plate 32 which together with the rubber pad 7 supports the vehicle load. The rubber pad 7 can be modified other types of adapters depending on the configuration of the pick-up points on the vehicle.

Figure 3:
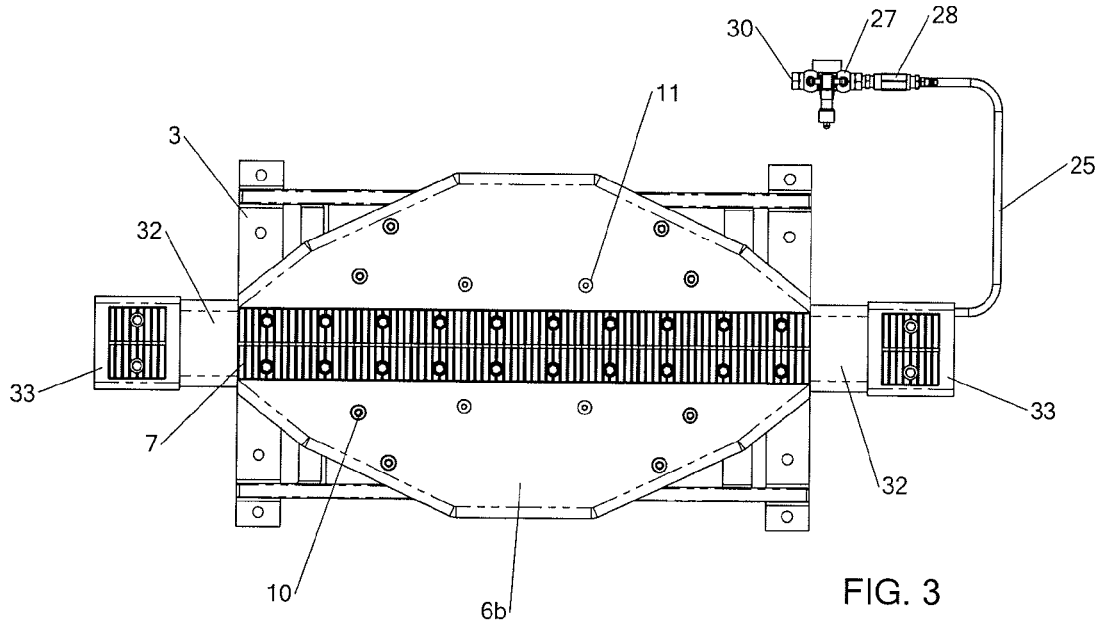
FIG. 3 illustrates a top perspective of the jack of FIG. 1.
Figure 4:
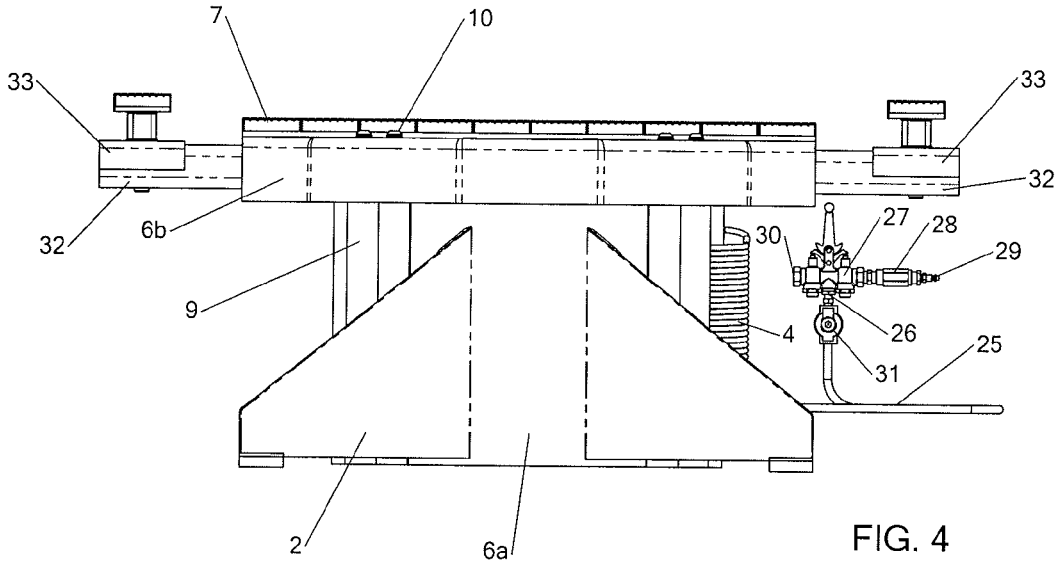
FIG. 4 is a front perspective of the jack of FIG. 1 in the lowered position.

Steel guide bars 9 are used to further stabilize the movement of the jack and to ensure that the movement of the stroke is unidirectional. The steel guide bars 9 are housed inside steel tubes 15 which are securely welded to the sides of the lower frame assembly 6*a* and include stoppers (not shown) that stop the jack 1 from extending beyond a predetermined height. Referring to FIGS. 3 and 4, the guide bars 9 are fixed in place at both ends with fasteners 10. The number of guide bars used depends on the weight to be supported. As examples only, 12,000 lbs uses 6 bars; 25,000 lbs uses 10 bars; 6,0000 lbs uses 4 bars.

Referring to FIGS. 8*a*, 8*b*, 9*a* and 9*b*, at the heart of the jack is the air bellow assembly. The assembly combines two air bellows so that they work on conjunction with each other to produce the desired height. The upper air bellow 21 is fixed in place to the top plate 19 and the upper frame assembly 6*b* with fasteners 11, and the lower bellow 22 is fixed in place the bottom plate 17 with fasteners 18. Both the top plate 19 and bottom plate 17 represent the static sections of the air bellow assembly.

Figure 5:
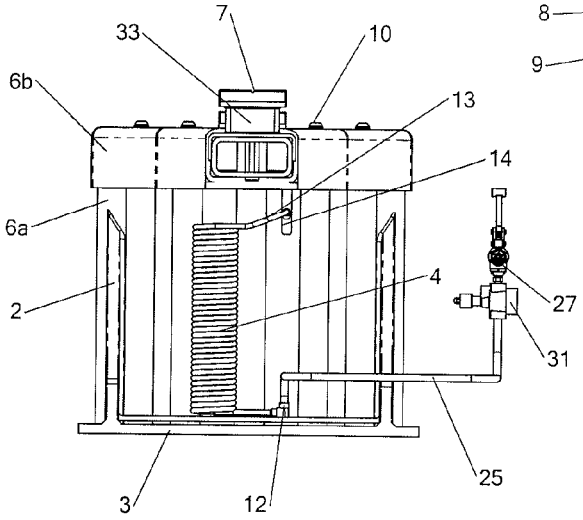
FIG. 5 is a side perspective of the jack of FIG. 1 in the lowered position showing the position of the air tube coil in the contracted state.
Figure 6:
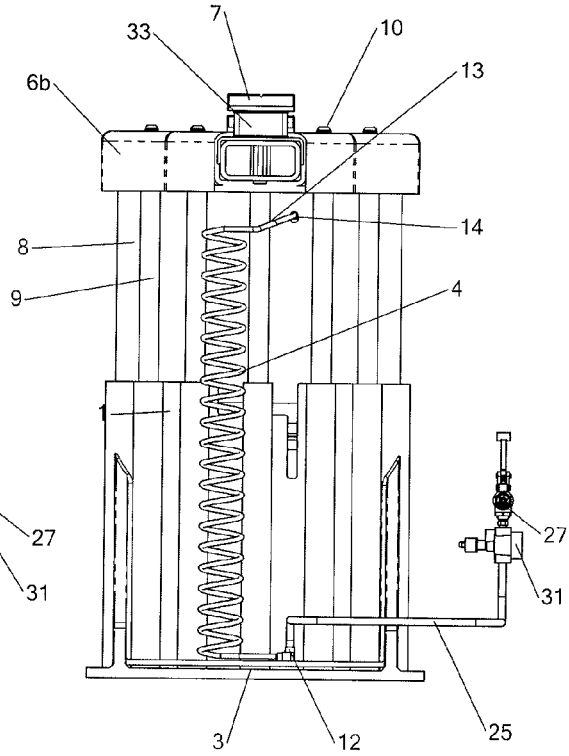
FIG. 6 is a side perspective of the jack of FIG. 1 in the lowered position showing the position of the air tube coil in the expanded state.
Figure 7:
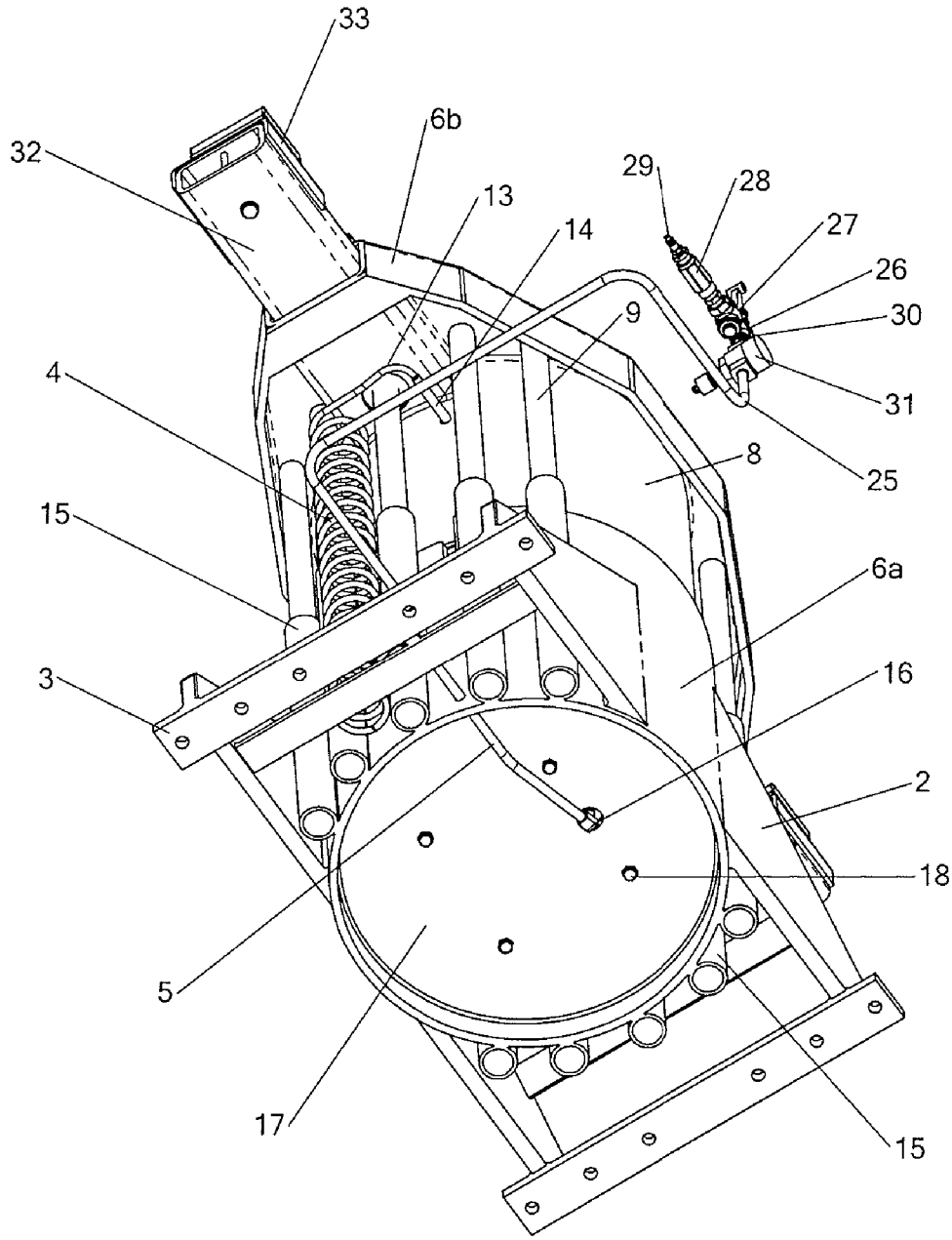
FIG. 7 is a bottom perspective of the jack of FIG. 1 in the raised position showing the position of the bottom air tube and the anchoring brackets.
Figure 8A:
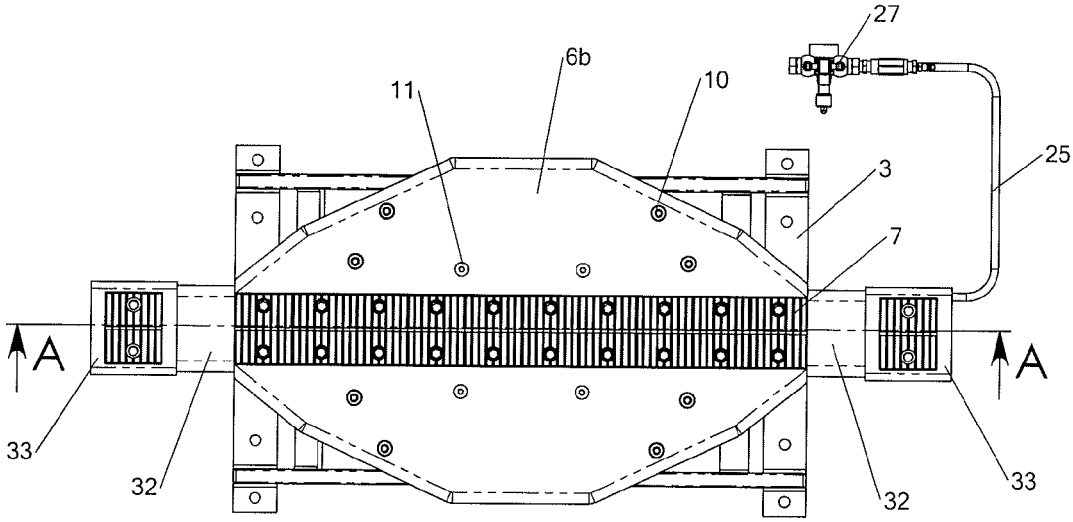
FIG. 8*a* is a top view of the jack of FIG. 1 in a lowered position illustrating cross-sectional line A-A.
Figure 8B:
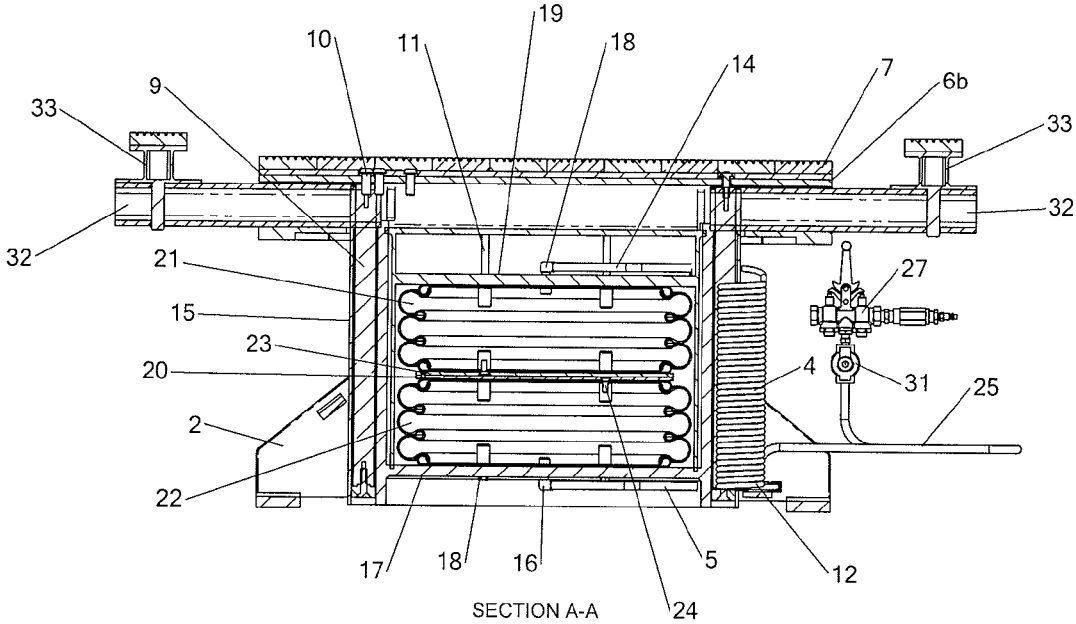
FIG. 8*b* is a cross-sectional view of the jack of FIG. 8*a* illustrating the position of the two air bellows in a contracted state.
Figure 9A:
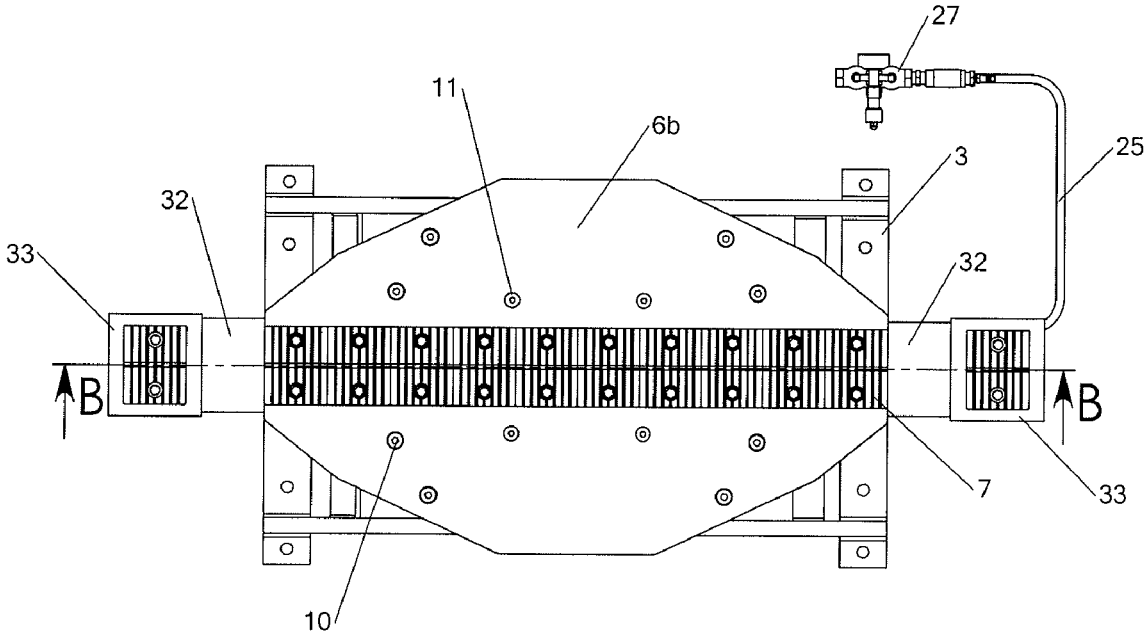
FIG. 9*a* is a top view of the jack of FIG. 1 in a raised position illustrating cross-sectional line B-B.
Figure 9B:
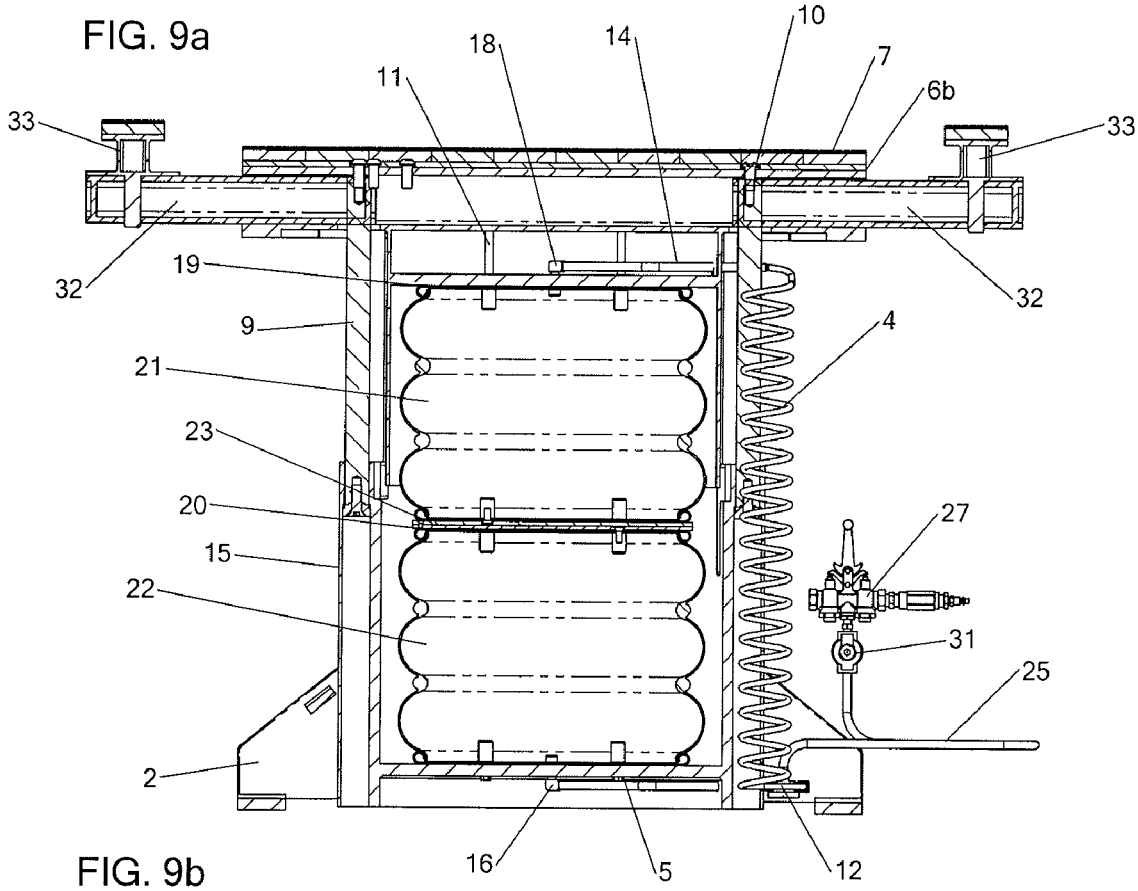
FIG. 9*b* is a cross-sectional view of the jack of FIG. 9*a* illustrating the position of the two air bellows in an expanded state.

Each of the two air bellows 21, 22 in the dynamic segment of the jack is attached to an air bellow attachment plate 20 with fasteners 24 and the air bellow attachment plates 20 are attached to each other with fasteners 23. Referring to FIG. 7, upper air bellow 21 is attached to the air supply through the upper air bellow air feed tube 14 which is then connected through the coiled air tube-to-upper air bellow air feed tube air fitting converter 13 to the coiled air tube 4. The lower air bellow is connected to the air supply through the lower air bellow-to-lower air bellow air feed tube air fitting converter 16 to the lower air bellow air feed tube 5. Referring to FIGS. 5 and 6, both the coiled air tube 4 and the lower air bellow air feed tube 5 is connected air to a T air fitting 12. This is connected to the main air supply hose 25 and eventually to a 3-way air valve 27 through a main air supply-to-3-way valve air fitting converter 26. The 3-way air valve 27 consists of a one way air flow check valve 28, an air exhaust fitting 30 and a main air supply source air fitting connecter 29 to connect the entire unit to the main air compressor.

The jack 1 operates on 120 psi of clean air and produces a stroke of 18 inches in the vertical direction. The combined stroke of the two bellows plus the plates in between all work together to provide an 18". When the air supply is provided and the 3-way valve 27 is in the up position, air will travel through the T air fitting 12 via the main air supply hose 25 and fill both the upper air bellow 21 and the lower air bellow 22 through the coiled air tube 4, the upper air bellow air feed tube 14 and the lower air bellow air feed tube 5 respectively. The inflated air bellows 21 and 22 will push against the upper plate 19 inside the inside shell 8 and raise the upper frame assembly 6*b*. The bellows move the same amount. The load of the vehicle will rest on the rubber pad 7 or can rest on an adapter that can be modified for any vehicle depending on the configuration of the pick-up points on the vehicle. For example, SUV's have larger tires than a normal sedan and therefore the jack needs to be raised more before it comes into contact with the axle. Using a height adapter allows the jack contact points to be 'raised' so that the vehicle starts to lift with little rise from the jack.

As the upper frame assembly 6*b* is raised the guide bars 9 will extend out of the guide bar housing tubes 15 until the stoppers connect. These bars will ensure that the movement of the jack in is one direction only and also act to stabilize the vehicle when it is being lifted. At this point the jack will be fully extended and maximum stroke will be achieved. The coiled air tube 4 will also extend to follow the upper air bellow feed tube 14.

When the 3-way valve 27 is in the down position the air bellows 21 and 22 will deflate together. The air will travel out through the upper air bellow 21 and the lower air bellow 22 through the upper air bellow air feed tube 14, the coiled air tube 4, and the lower air bellow air feed tube 5 respectively, through the T air fitting 12 and exit through the 3-way air valve 27 via the main air supply hose 25. The one way air flow check valve 28 will ensure that the air exits through the air exhaust fitting 30 on the 3-way air valve 27 and does not feed into the main air source. Thus the air supply system operates as both the air delivery system in inflate the air bellows 21 and 22 and as the air release system. When the air is released the guide bars 9 retract back into the guide bar housing tubes 15. Both bellows are inflated concurrently, lifting the top plate. Guide bars are there to guide and provide stability (vehicle does not sway once lifted), not lift the car.

As an example only, possible suitable bellows include Firestone bellows.

Preferably, the air bellow assembly is completely enclosed within the frame assembly to protect it from the environment.

Optional features may be included in jack 1. Alternatively, the pick up point range of the jack can be extended via two extension arms 32 located on either side of the upper frame assembly 6*b*. When not in use, the extension arms 32 retract completely inside the upper frame assembly 6*b*.

Also, optional features may include adapters that can be added to provide a more efficient lift, i.e. allow the vehicle to be lifted to a complete 18" height from the ground level. As an example only, possible suitable dimensions from an 18 inch lift are:

Frame body: 17½ inch wide, 40 inch length, 24¼ inch height

Dual Bellow: 15.2 inch diameter, Approx 9 inch compressed height, 27 inch height fully inflated.

To provide for example a 20 inch left, the frame body should be an additional 2 inches in height.

Adapters also allow the jack to come as close as possible to the vehicle before lifting to maximize the stroke of the lift.

A pair of pin adapters 33 lock onto the extension arms 32 through a hole located on the extension arms 32. The pin adapters 33 can be made in varying heights to allow the jack to come as close as possible to the vehicle before lifting. A locking system can be added for added safety, or to allow the jack to be used at different height levels for long periods of time. The safety locking mechanism can be incorporated to ensure that if a malfunction occurred with the air system while a load was lifted, then the jack would not drop the length of the stroke, i.e. 18", rather a smaller distance, i.e. 2"; thus allowing for less damages to the load and safer work environment. The safety mechanism can be of any suitable type, such as an air-operated mechanism or a 2-handed mechanism.

Further, the stationary jack can be modified so that it is mobile. In this case, it could be rolled on the floor, in a pit, or rolled on any track. Any suitable rail design may be used.

By keeping the bellows as two separate units within the same assembly, the bellows can be used within the recommended parameters of the manufacturers. This keeps all warranties current. Further, use of one bag increases the stability of the jack as there will be less/no swaying during use.

The rate of speed at which the jack raises and lowers is preferably controlled by a metered air valve 31 which is located in between the three-way air valve 27 and the "T" Air fitting 12.

It should also be understood that the present invention can be modified to adjust for various stroke lengths other than 18". It should further be understood that, while the use of two bellows is disclosed as an example embodiment, additional bellows can be used to provide more lift.

Numerous modifications may be made without departing from the spirit and scope of the invention as defined in the appended claims.

DESCRIPTION OF LABELED COMPONENTS

1. Jack
2. Supporting Arms
3. Anchoring Brackets
4. Coiled Air Tube
5. Lower Air Bellow Air Feed Tube
6*a*. Lower Frame Assembly
6*b*. Upper Frame Assembly
7. Rubber Pad
8. Inside Shell
9. Guide Bars
10. Guide bar Fasteners
11. Upper Air Bellow Fasteners
12. "T" Air Fitting
13. Coiled Air Tube-To-Upper Air Bellow Air Feed Tube Air Fitting Converter
14. Upper Air Bellow Air Feed Tube
15. Guide Bar Housing Tube
16. Lower Air Bellow-To-Lower Air Bellow Air Feed Tube Air Fitting Converter
17. Lower Plate
18. Lower Air Bellow Fasteners
19. Upper Plate
20. Air Bellow-To-Air Bellow Attachment Plates
21. Upper Air Bellow
22. Lower Air Bellow
23. Air Bellow Attachment Plate Fasteners
24. Air Bellow-To-Air Bellow Attachment Plate Fasteners
25. Main Air Supply Hose
26. Main Air Supply-To-3-Way Valve Air Fitting Converter
27. 3-Way Air Valve
28. One Way Air Flow Check Valve
29. Main Air Supply Source Air Fitting Connecter
30. Air Exhaust Fitting
31. Metered Air Flow Valve
32. Extension Arms
33. Pin Adapters
34. Lifting Plate

What is claimed is:

1. An all-air jack for lifting a vehicle load, the jack comprising:

an upper frame assembly and a lower frame assembly;

steel guide bars on either side of the upper and lower frame assemblies to ensure movement of the jack is unidirectional and stabilized;

an upper plate at a top end of the upper frame assembly adapted to support the vehicle load;

an upper air bellow positioned in the upper frame assembly;

a lower air bellow positioned in the lower frame assembly;

an upper air bellow attachment plate fastened to the upper air bellow;

a lower air bellow attachment plate fastened to the lower air bellow and parallel to the upper air bellow attachment plate;

air bellow plate fasteners fastening together the upper air bellow attachment plate and the lower air bellow attachment plate;

a coil air tube in fluid communication with the upper air bellow;

an upper air bellow air feed tube in fluid communication with the coil air tube;

a lower air bellow air feed tube in fluid communication with the lower air bellow; and a main air supply in fluid communication with the coil air tube and the lower air bellow air feed tube to supply air thereto, wherein when air flow is supplied from the main air supply, air flows to the lower air bellow via the lower air bellow air feed tube and air flows to the upper air bellow through the upper air bellow air feed tube and the coil air tube to inflate the lower and upper air bellows an equal amount; and wherein the air coil extends as air is supplied thereto to raise the upper plate of the jack.

2. The jack of claim 1, wherein the first and second air tubes and air supply are all connected by a 3-way air valve.

3. The jack of claim 1, wherein 120 psi of air is used to inflate the bellows.

4. The jack claim 1, further comprising extension arms on either side of the upper frame assembly to expand the pick up point of the jack.

5. The jack of claim 1, further comprising anchoring brackets to fix the jack to the ground.

6. The jack of claim 1, further comprising a rubber pad on a top frame of the jack to support the vehicle.

7. The jack of claim 1, wherein the upper air bellow is fixed in place to a top plate of the jack and the lower bellow is fixed in place a bottom plate.

* * * * *